United States Patent [19]

Hall

[11] Patent Number: 4,665,650

[45] Date of Patent: May 19, 1987

[54] CONTROL GATE ASSEMBLY

[76] Inventor: Richard C. Hall, 5301 Southcenter Blvd., Seattle, Wash. 98188

[21] Appl. No.: 861,833

[22] Filed: May 12, 1986

[51] Int. Cl.[4] ..... E05F 15/10

[52] U.S. Cl. ..... 49/334; 49/280; 49/335; 74/99 A

[58] Field of Search ..... 49/49, 280, 281, 333, 49/334, 137, 335, 337, 338, 349; 74/99 A, 99 R

[56] References Cited

U.S. PATENT DOCUMENTS

| | | | |
|---|---|---|---|
| 2,883,183 | 4/1959 | Finsterwalder | 49/334 |
| 3,829,826 | 10/1974 | Ries | 49/336 |
| 4,231,190 | 11/1980 | Tieben | 49/334 |
| 4,270,312 | 6/1981 | Courtis | 49/385 |
| 4,403,449 | 9/1983 | Richmond | 49/340 |
| 4,472,908 | 9/1984 | Wanzl | 49/334 |
| 4,490,941 | 1/1985 | Mamach | 49/337 |

FOREIGN PATENT DOCUMENTS

| | | | |
|---|---|---|---|
| 1961573 | 7/1971 | Fed. Rep. of Germany | 49/334 |
| 3021114 | 12/1981 | Fed. Rep. of Germany | 49/334 |
| 322144 | 3/1970 | Sweden | 49/334 |

*Primary Examiner*—Peter A. Aschenbrenner
*Assistant Examiner*—Gerald A. Anderson
*Attorney, Agent, or Firm*—Thomas W. Secrest

[57] ABSTRACT

This invention is directed to a gate assembly. It is possible to open a gate and close the gate from a remote position such as being in an automotive vehicle. The gate assembly comprises a tubular support and guide, an inner rotatable guide follower in the tubular support and guide. An outer rotatable follower outside of the tubular support and guide. The outer rotatable follower and the inner rotatable guide follower are connected. A gate is connected to the outer rotatable follower. There is a means for simultaneously elevating and rotating both the inner rotatable guide follower and the outer rotatable guide follower to move the gate.

20 Claims, 9 Drawing Figures

CONTROL GATE ASSEMBLY

THE BACKGROUND OF THE INVENTION

A gate is old.

There are various forms of gates. One form of a gate comprises a vertical gate-post, a gate and two hinges interconnecting the vertical gate-post and the gate. The gate swings horizontally around the vertical gate-post. Sometimes, there are two vertical gate-posts and two gates which swing horizontally around the two vertical gate-posts and inwardly.

On a farm or a ranch the gates may take a more simple form such as a vertical stile of wood and wire. There are two spaced apart vertical posts. Barbed wire or woven wire is attached to one of the posts and the other end of the barbed wire or woven wire is attached to the vertical stile. There are loops on the other vertical post and the vertical stile can be positioned in the loops to form a rather loose crude gate for blocking livestock. The loop on the other vertical post can be of wire such as barbed wire or baling wire. In using this type of gate the upper loop can be moved away from the vertical post and the vertical stile moved out of the lower loop and towards the other vertical post. This opens the gateway for livestock and the like to move.

There are some gate assemblies which have a horizontal axis. A gate rotates vertically around the horizontal axis. Generally, there will be a counterweight to assist in the vertical rotation of the gate around the horizontal axis.

In certain instances there is a vertical gate-post. A heavy metal tube is hinged to the vertical gate-post and rotates horizontally around the vertical gate-post. Some of these gates are used in restricted areas such as on logging roads, construction projects and the like.

The above described gates serve the purpose of blocking a passageway and also allowing the passageway to be opened for traffic to move. A person in an automotive vehicle and wanting to pass through the gate which is closed must stop the automotive vehicle. Then the person gets out of the vehicle and goes to the gate and opens the gate. Then the person can drive the vehicle through the passageway and stops the vehicle again, gets out of the vehicle and closes the gate. Then the person can get in the vehicle and drive away. This means that the individual must get out of the automotive vehicle twice and also must get into the automotive vehicle twice. It is seen that this is time consuming. If the individual be in a hurry the getting out of the automotive vehicle and getting into the automotive vehicle and repeating this procedure is time consuming. With some individuals having a physical impairment it is difficult to get out of the automotive vehicle and also to get into the automotive vehicle. In fact, this is a hardship and frustrating to such an individual. In addition, it is an annoyance to such an individual. Further, it is an inconvenience to get out of the automotive vehicle twice and to get into the automotive vehicle twice in inclement weather such as rain, where there is mud or snow, and where there is possibly ice or packed snow. The possibility of slipping on the packed snow and ice or on mud is a distinct possibility and the individual in getting out of the automotive vehicle and walking towards the gate may fall and hurt oneself. Also, in falling the individual may get the clothes dirty. Further, in certain instances a person getting out of an automotive vehicle leaves the sanctuary of the automotive vehicle and there may be another individual nearby who may take the opportunity to mug the driver of the automotive vehicle and physically harm the driver of the automotive vehicle when the driver is out of the vehicle. In addition, in certain instances, the gate may be heavy and hard to move. For example, with a small individual or an older person there may be difficulty in opening and closing the gate. Some gates are so heavy and difficult to move that it is a distinct inconvenience for a small or weak individual to move such a gate.

Some gates are powered by a power means which is remote. These gates can be opened and closed remotely. For example, there are many garage doors which can be remotely opened and remotely closed by the driver of an automotive vehicle. It is not necessary for the driver of the automotive vehicle to get out of the automotive vehicle to open the garage door or to close the garage door.

Prior to preparing this patent application a patent search was made. Five patents were found in this patent search. These are:

| PATENTEE | NO. | ISSUING DATE |
|---|---|---|
| Robert J. Ries | 3,839,826 | October 8, 1974 |
| James Tieben | 4,231,190 | November 4, 1980 |
| Thomas M. Courtis | 4,270,312 | June 2, 1981 |
| Moscow K. Richmond | 4,403,449 | September 3, 1983 |
| Rudolf Wanzl | 4,472,908 | September 25, 1984 |

The patent to Ries is for a gate 14 which rotates vertically. There is a gate-post 4. There is a horizontal axis 16. The gate 14 rotates vertically around the horizontal axis 16. There is a horizontal output shaft 24 of a gear and motor combination 26 for rotating the gate 14. Also, there is a radio receiver 66 for controlling the motor and gear combination 26 for controlling the rotation of the gate 14.

The patent to Tieben illustrates a vertical gate-post 10. There is a gate 14. Hinges 16 and 18 interconnect the vertical gate-post 10 and the gate 14. There is an electric motor 64. This electric motor 64 may be a 12 volt electric motor. The electric motor has an output shaft and on the end of the output shaft there is a drive sprocket 62. There are idler sprockets 48 and 50. There is a chain 76 which runs around the sprocket 62, 48 and 50. The motor 64 is a reversible motor. The gate 14 rotates horizontally around the vertical gate-post 10. There is a radio controlled relay 68 which makes it possible for the gate to rotate in one direction to open the passageway and for the gate to rotate in the opposite direction for closing the passageway.

Courtis et al teaches of a gate 12. There is a support means 11. There is a lower horizontal pivot means 18. There is a gate activating means 14. There is a sprocket 34 on the upper part of the gate. There is a chain 33 interconnecting the sprocket 34 and the gate activating means 14. There can be a radio transmitter for controlling the gate activating means 14. With activation the gate activating means 14 can move the chain 33 so that the gate 12 rotates vertically around the axis 18 so as to open the passageway and likewise with activation the motor 14 can cause the chain to move to lower the gate 12 to close the passageway.

The patent to Richmond shows a gate 10 and a vertical gatepost 12. There is appropriate structure for the gate 10 to be attached to the vertical gate-post 12. There are two lever arms 40 and 42 with a pivot 44 between the lever arms and interconnecting the two lever arms. There is a drive arm 38 connecting with the lever arm 40. There is a worm gear 70 which rotates so as to move the arms 38 and 42. With the movement of these arms the gate can rotate horizontally around the vertical gate-post 12 so as to move and to open the passageway and, likewise, can rotate so as to move and close the passageway.

The patent to Wanzl discloses a vertical gate-post 10 having a cylindrical base part 12. There is a cylindrical metal portion 14 which carries a C-shaped gate 5. There is a reversible squirrel cage motor 16 which has a rotary output shaft 17 connecting to the cylindrical middle portion 13. There is an electric eye sensor arrangement 6. With the activation of the electrical eye sensor arrangement the reversable motor 16 is activated to rotate the middle portion 13 to open the passageway and, likewise, to rotate to close the passageway.

A BRIEF DESCRIPTION OF THE INVENTION

This invention is directed to a gate assembly wherein the gate simultaneously rotates horizontally and moves vertically. To the best of my knowledge and information I know of no such gate which simultaneously rotates horizontally and moves vertically. The gate assembly comprises a tubular support and guide, an inner rotatable guide follower and an outer rotatable follower. The tubular support and guide supports the other components of the gate assembly including the gate. The inner rotatable guide follower is mainly inside of the tubular support and guide. The inner rotatable guide follower can move and rotate inside of said tubular suport and guide. The outer rotatable follower is on the outside of the tubular support and guide and can move and rotate with respect to the tubular support and guide. The outer rotatable follower connects with the inner rotatable guide follower to be an integral unit. The gate is operatively connecting with the outer rotatable follower. The gate is attached by a hinge means to the outer rotatable follower. There is a power means for rotating the gate horizontally and also for moving the gate vertically. Further, this gate assembly can have a radio receiver for receiving radio signals from a person in an automobile so that the person need not get out of the automobile. In the automobile there can be a transmitter. The person while sitting in the automobile can activate the transmitter and send a signal to the radio receiver for opening the gate to allow the person to drive through. Then, after the person has driven through the transmitter can be activated and a signal sent to the radio receiver to close the gate.

THE DRAWINGS

In the drawings it is seen that:

THE DETAILED DESCRIPTION OF THE INVENTION

Figure 1:
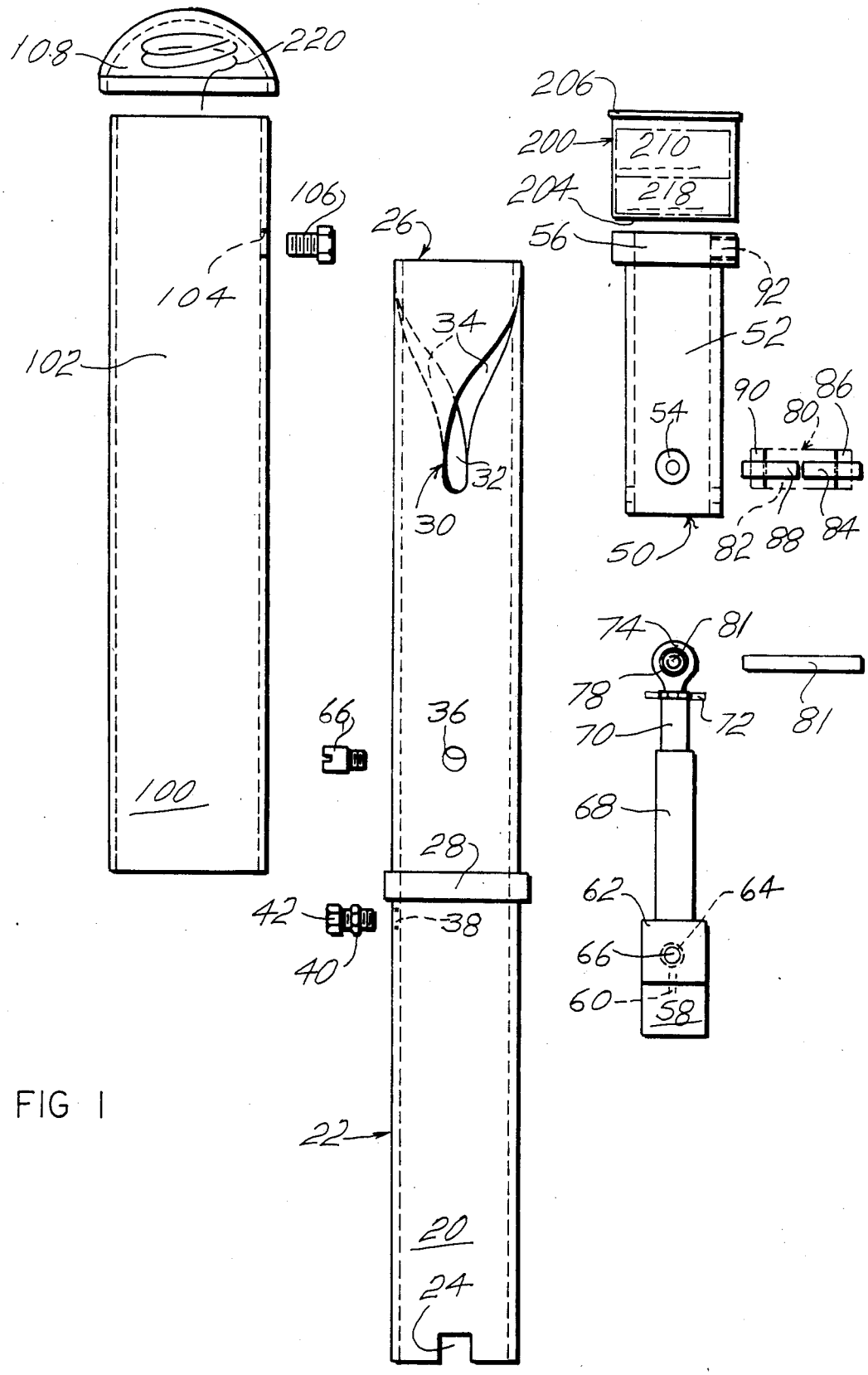
FIG. 1 is an exploded view of some of the main components of the gate assembly and, in particular, a tubular support and guide, an inner rotatable guide follower and an outer rotatable follower.

Three of the main components of the gate assembly are the tubular support and guide 20, the inner rotatable guide follower 50 and the outer rotatable follower 100. These are illustrated in FIG. 1.

The tubular support and guide 20 can be considered as comprising a lower member 22 having a notch 24 in the lower end and an upper member 26. A stop 28 is welded below the middle part of the tubular support and guide 20. The stop 28 designates the ground level for the guide 20.

In the upper part of the upper member 26 it is seen that there are two guides 30 or two slots 30. Each of the guides 30 has a lower part 32 and an upper part 34. The lower part 32 is substantially vertical and the upper part 34 curves so as to have a change in the vertical and a change in the horizontal. In FIG. 1 the solid upper part 34 curves to the right and the phantom upper part 34 curves to the left. In the upper member 26 it is seen that there are a plurality of holes or passageways 36 for receiving trunion pins 66. Below the holes 36 and below the stop 28 there is a tapped hole 38 for receiving a threaded nipple 42. There is positioned between the member 22 and the nipple 42 a washer 40.

The inner rotatable guide follower 50 comprises a tubular member 52. In the tubular member 52 there are two aligned holes 54. On top of the tubular member 52 there is a collar 56. In the collar 56 there is a tapped recess 92. In the tubular member 52, and below the holes 54, there are two aligned holes 57.

The external dimension of the tubular member 52 is smaller than the internal dimension of the upper member 26. This makes it possible for the tubular member 52 to move and to rotate in the upper member 26. It is to be clearly understood that most of the tubular member 52 is positioned in the upper member 26 and the tubular member 52 moves and rotates inside of the upper member 26.

The outer dimension of the collar 56 is greater than the inner dimension of the upper member 26. As a result the collar 56 can rest on the upper member 26. In practice, the outer dimension of the collar 56 may be greater than the outer dimension of the upper member 26 to insure that the collar 56 rests on the upper member 26 so as to limit the penetration of the tubular member 52 into the upper member 26.

In FIG. 1 it is seen that there is an electric motor 58 having an output shaft 60. The output shaft 60 connects with a gear box 62. In the gear box 62 are a plurality of tapped holes 64. The electric motor 58 and the gear box 62 are positioned in the lower member 22. A number of trunion pins 66 are positioned in the holes or passageways 36 and also in the tapped holes 64 so as to definitely position the gear box 62 with respect to the upper member 26. In other words, the gear box 62 cannot rotate with respect to the lower member 22. Further, the electric motor 58 and the gear box 62 can be in a common housing so that the electric motor 58 and the gear box 62 do not rotate or move with respect to each other. The gear box 62 connects with the screw housing 68. In the screw housing 68 there is a screw 70. On the upper part of the screw 70 there is a spacer or a torus 72. There is on the upper part of the screw 70 an eye 74. The eye 74 has a hole 78 for receiving a pin 81. The pin 81 is in the hole 78 and the two passageways 57 in 50.

There is a pin assembly 80 comprising a sleeve 82 or a pipe 82. There is positioned in one end of the sleeve 82 a first rod 84. A bearing 86 surrounds the first rod 84 and is positioned near the sleeve 82. There is also positioned in the sleeve 82 a second rod 88. A second bearing 90 surrounds the second rod 88 and is positioned near the sleeve 82.

It is to be recalled that in the tubular member 52 there are two aligned holes 54. The pin assembly 80 is positioned in the two aligned holes 54 with a bearing in each hole. The pin assembly 80 is also positioned in the two guides 30 or the two guide slots 30 with the first rod 84 in one of the guides 30 and the second rod 88 in the other guide 30. Further, it is to be recalled that the gear box 62 is positioned in the upper member 26 and cannot rotate. With the actuation of the electric motor 58 the screw 70 is rotated and either elevated or lowered. With the pin 81 in the hole 78 and in the holes 57 of the tubular member 52 and the pin assembly 80 in the two guide slots 30 of the upper member 26 and in the holes 54 of the inner rotatable guide follower 50 the follower 50 is moved and rotated. If the screw 70 is moved outwardly of the screw housing 68 then the pin assembly 80 moves upwardly in the lower part 32 of the guide 30 and also moves upwardly and horizontally in the curved upper part 34 of the guide 30. As a result of the movement of the pin assembly 80 in the guide 30 the inner rotatable guide follower 50 also moves upwardly and also rotates horizontally with the movement of the pin assembly 80 in the upper curved part 34 of the guide 30. Conversely, with the screw 70 being retracted into the screw housing 68 the pin assembly 80 moves downwardly in the upper part 34 of the guide 30 so as to rotate in the upper curved part 34 of the guide 30. Likewise, the inner rotatable guide follower 50 moves downwardly and rotates inside of the upper member 26. With the pin assembly 80 moving downwardly in the lower part 32 of the guide 30 the inner rotatable guide follower 50 moves downwardly in the upper member 26.

From the foregoing discussion it is seen that the inner rotatable guide follower 50 moves longitudinally in the upper member 26 or vertically in the upper member 26 when the pin assembly 80 is in the lower part 32 and rotates inside of the upper member 26 when the pin assembly 80 is in the upper part 34 on the guide 30.

The guide 30 extends through approximately 90°, horizontally. With the movement of the inner rotatable guide follower 50 following the movement of the pin assembly 80 in the upper part 34 of the guide 30 the inner rotatable guide follower 50 moves through 90° horizontally.

The outer rotatable follower 100 comprises a tubular member 102. In the upper part of the tubular member 102 there is a tapped passageway 104. A bolt 106 extends through the tapped passageway 104 and into the tapped recess 92 so as to unite the inter rotatable guide follower 50 and the outer rotatable follower 100. With the movement of the inner rotatable guide follower 50 the outer rotatable follower 100 will likewise move. There is positioned on top of the tubular member 102 a cap 108. The cap 108 can be a plastic cap and can be translucent to the passage of light. The plastic cap 108 seals the top of the tubular member 102 to keep out moisture and debris.

The inner dimension of the tubular member 102 is greater than the outer dimension of the upper member 26. Therefore, the tubular member 102 can move and can rotate with respect to the upper member 26.

With the movement of the inner rotatable guide follower 50, both longitudinally and rotationally, with respect to the tubular support and guide 20 the outer rotatable follower 100 also moves both longitudinally and rotationally with respect to the tubular support and guide 20.

With the attaching of a gate onto the tubular member 102 the gate will both move and rotate. Since the upper part 34 of the guide 30 extends through 90° horizontally then the tubular member 102 will rotate 90° horizontally and the gate will also rotate 90° horizontally.

Figure 2:
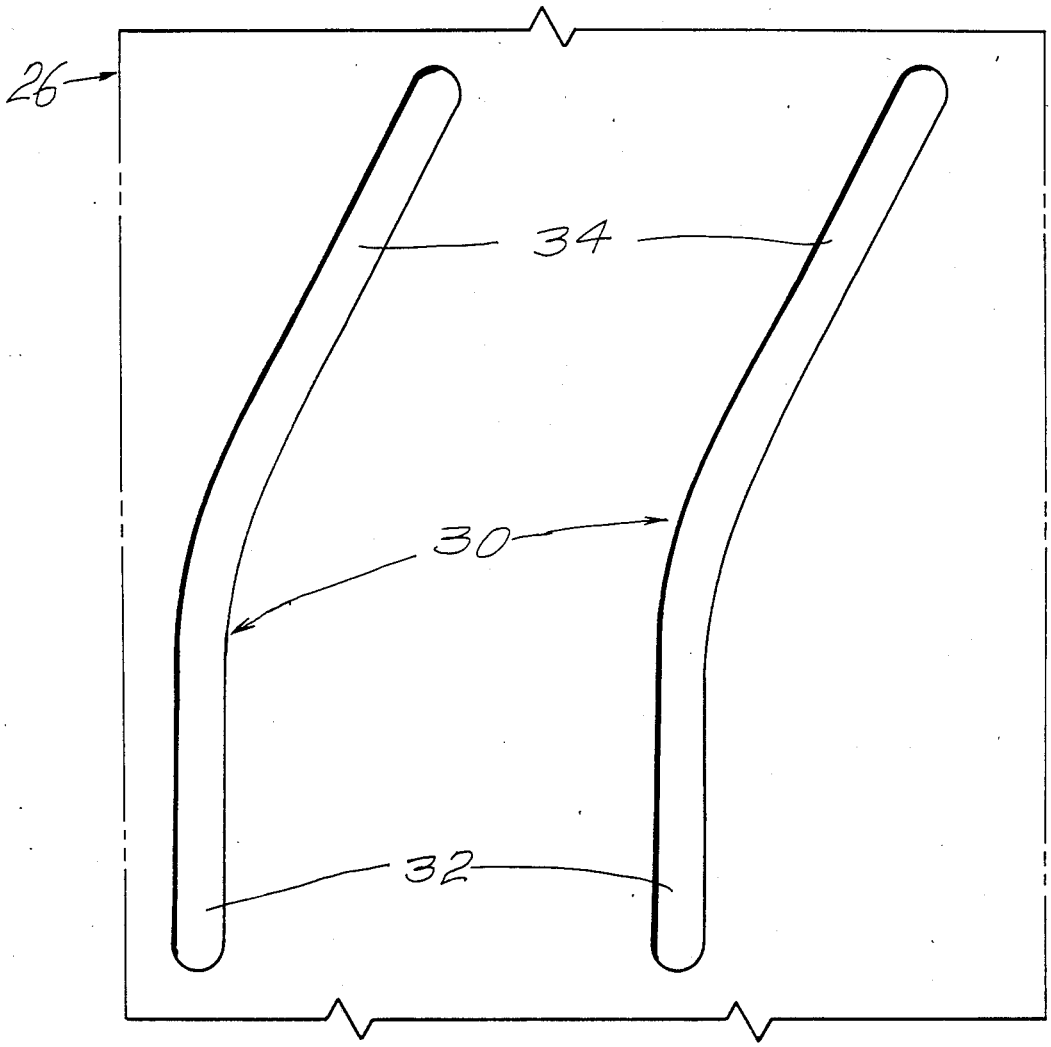
FIG. 2 is a fragmentary side elevational view of the tubular support and guide which has been projected flat from a tube.

In FIG. 2 there is a fragmentary portion of the upper member 26 as laid out flat. This fragmentary portion shows the two guides 30 having the lower part 32 and the upper part 34. The lower part 32 is substantially straight and runs longitudinally with respect to the member 26. The upper part 34 is curved and runs through approximately 90° laterally with respect to the upper member 26.

In FIG. 2 it is seen that with the pin assembly 80 in the lower part 32 that the pin assembly 80 will follow the lower part 32 to elevate the inner rotatable guide follower 50 and to also, simultaneously, elevate the outer rotatable follower 100. With the pin assembly 80 in the upper part 34 the pin assembly will follow the curved upper part 34 and elevate longitudinally and, simultaneously, rotate laterally through about 90° the inner rotatable guide follower 50 and the outer rotatable follower 100. In effect, the inner rotatable guide follower 50 and the outer rotatable follower 100 are elevated and rotated while moving upwardly in the guide 30 and, conversely, are lowered and rotated while moving downwardly in the guide 30.

Naturally, the outer dimension of the collar 56 is less than the inner dimension of the tubular member 102 so that the tubular member 102 will slip over the collar 56.

Figure 3:
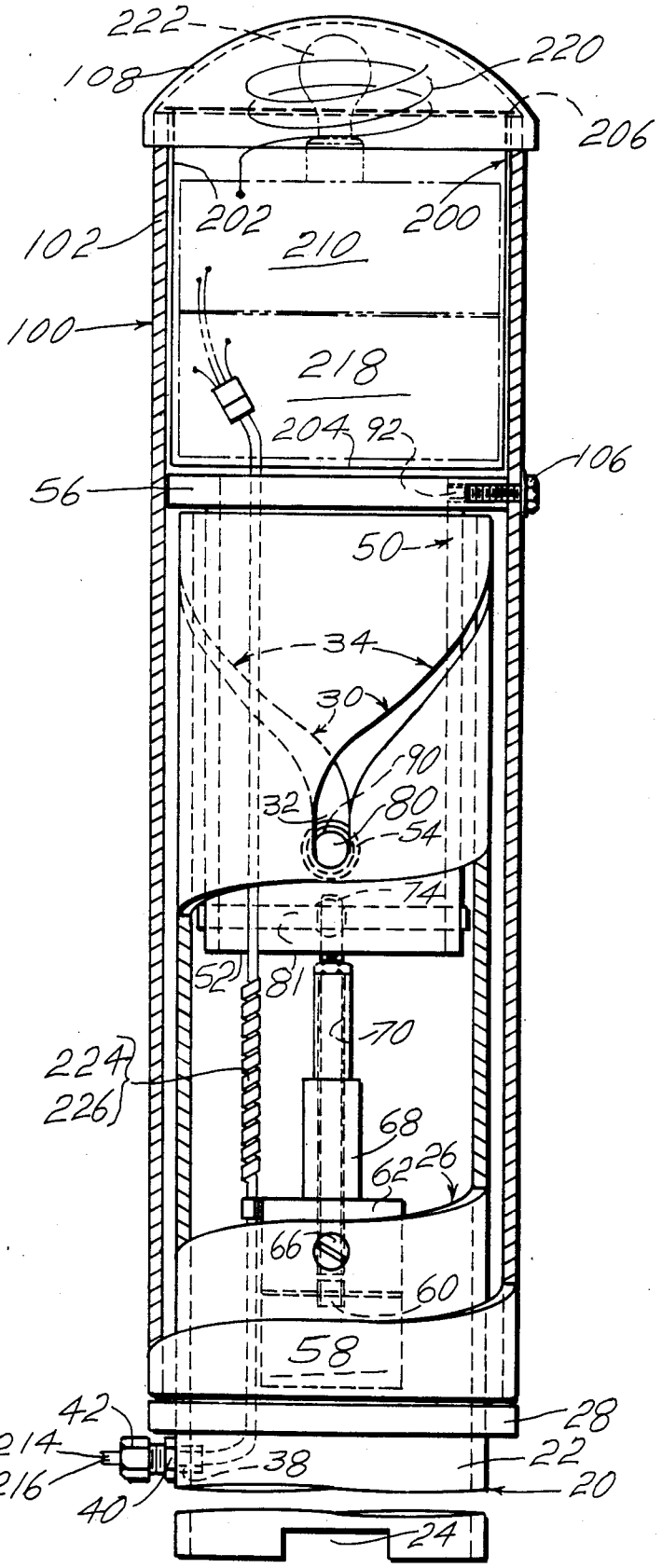
FIG. 3 is a fragmentary elevational view of most of the components of the gate assembly, viz., tubular support and guide, inner rotatable guide follower and outer rotatable follower, with some of the components in solid line and some of the components in phantom line.

In FIG. 3 there is illustrated the assembly of the tubular support and guide 20, the inner rotatable follower 50 inside of the upper member 26 and the outer rotatable follower 100 positioned over the inner rotatable guide follower 50 and, naturally, over the upper member 26. The relative positions of the electric motor 58 and the gear box 62 and the screw 70 are illustrated. Further, the relative positions of the outer rotatable follower 100 and the tubular support and guide 20 are illustrated.

Finally, the relative position of the inner rotatable guide follower 50, the tubular support and guide 20 and the outer rotatable follower 100 are illustrated.

Figure 4:
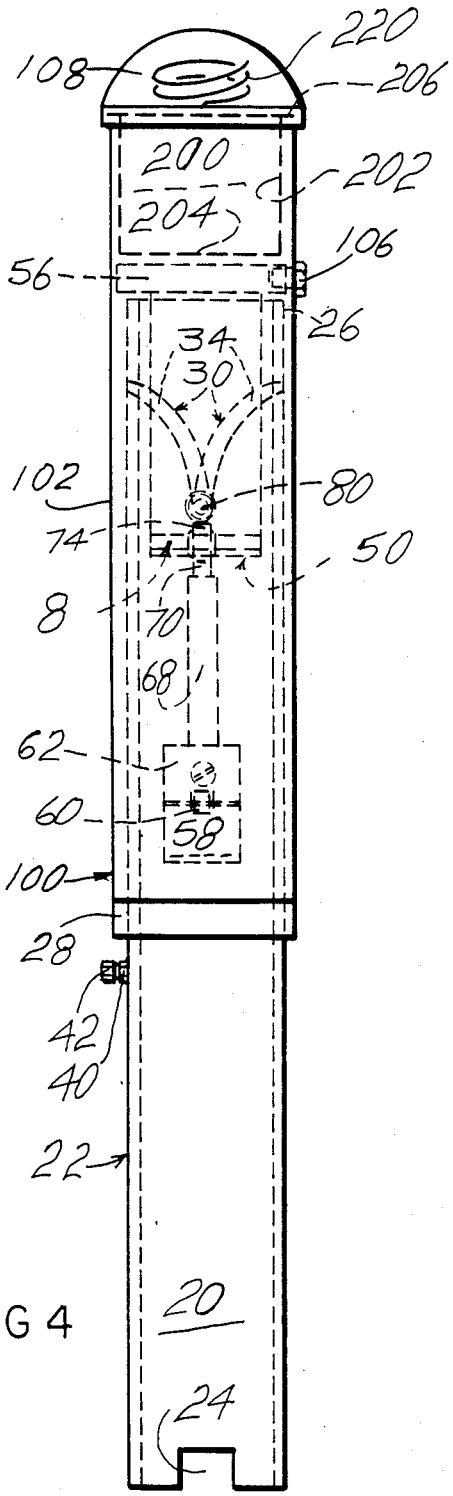
FIG. 4 is a side elevational view of the outer rotatable folower, in a lowered position, on the tubular support and gide.

In FIG. 4 there is illustrated the outer rotatable follower 100 in a lowered position on the tubular support and guide 20. In fact, the lower edge of the tubular member 102 is positioned close to the upper edge of the stop 28.

Figure 5:
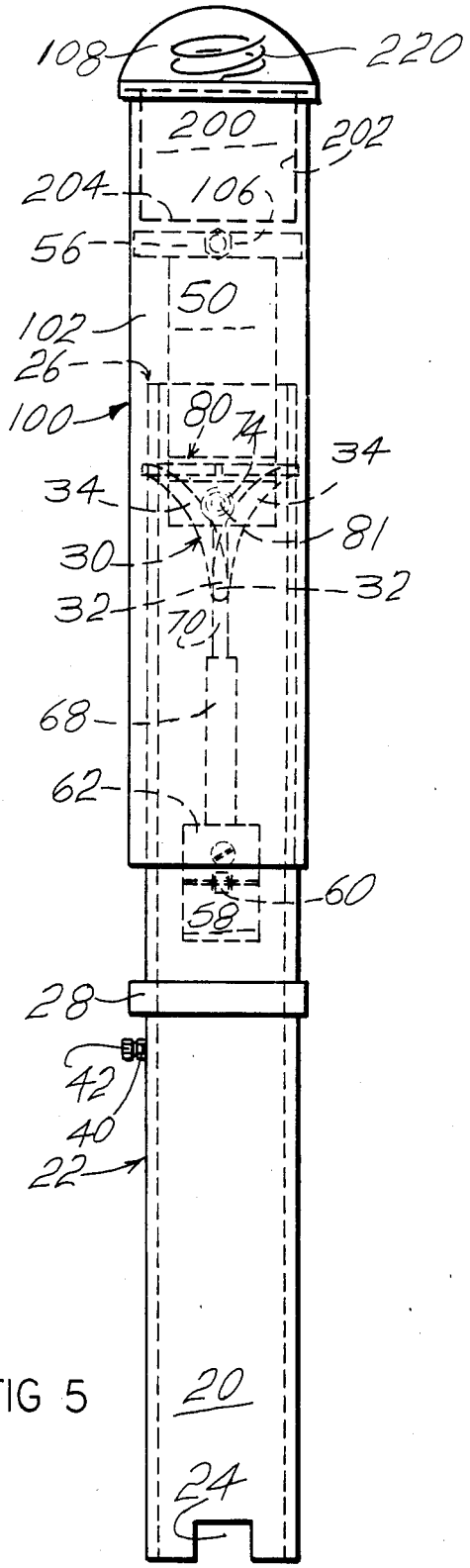
FIG. 5 is a side elevational view of the outer rotatable follower, in an elevated position, on the tublar support and guide.

In FIG. 5 the outer rotatable follower 100 is elevated with respect to the tubular support and guide 20. The lower edge of the tubular member 102 is positioned above and spaced apart from the upper edge of the stop 28.

The pin assembly is a guide follower in the slots 30. The bearings 86 and 90 are n the hole 54.

Figure 7:
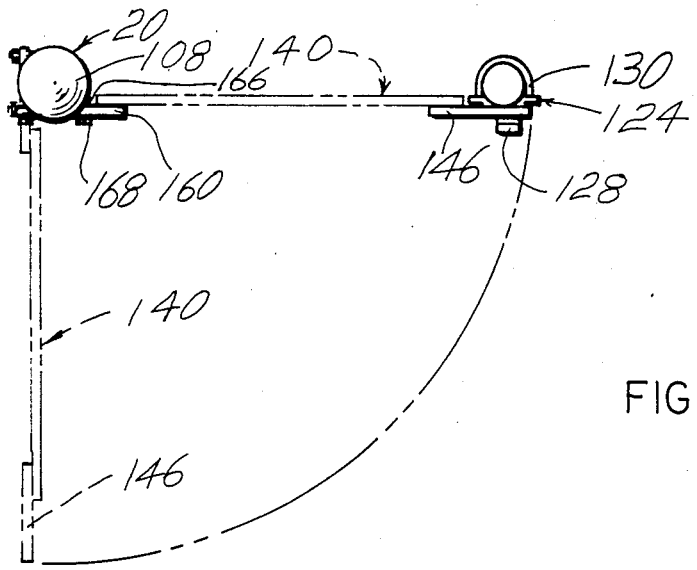
FIG. 7 is a top plan view of the gate assembly in an open position and also in a closed position and illustrates the outer rotatable follower, the gate and the latching post.
Figure 6:
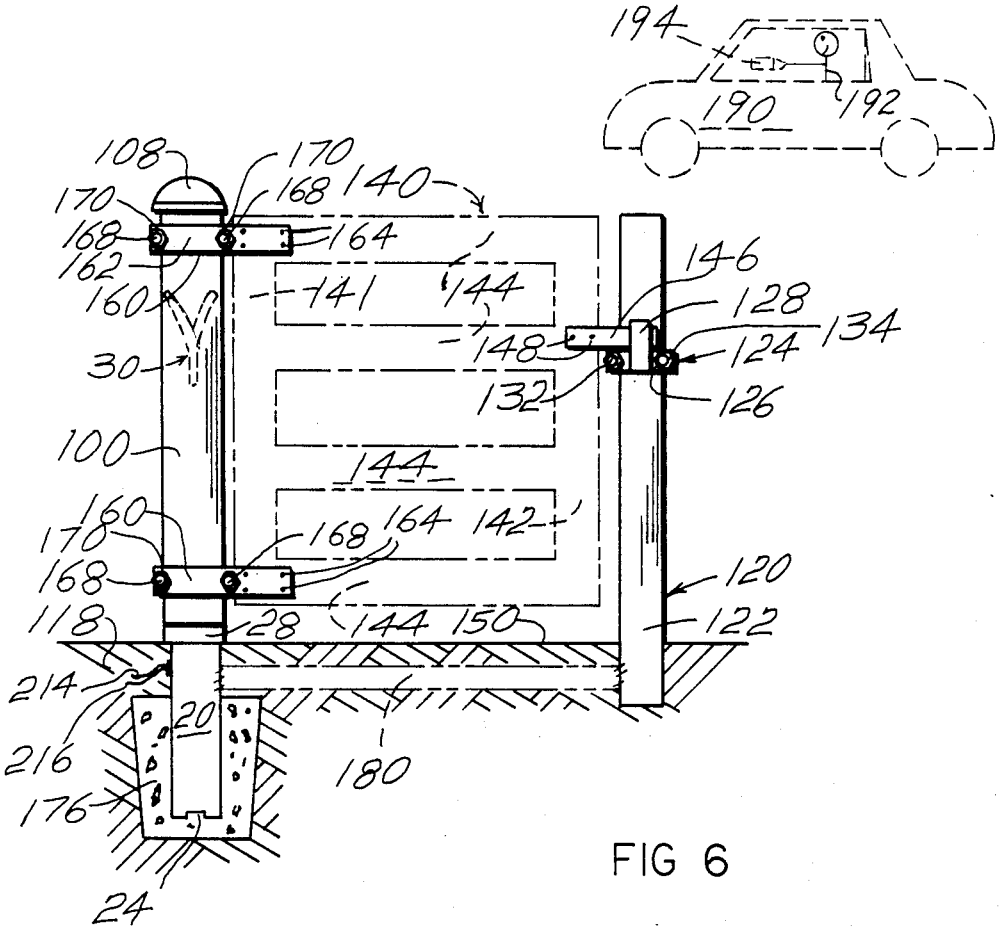
FIG. 6 is an elevational view of the gate assembly with the gate-post comprising the tubular support and guide, the outer rotatable follower, the outer rotatable follower; and the latching post in solide line and a connecting brace in phantom line between the latching post and the tubular support and guide.

In FIGS. 6 and 7 there is illustrated an embodiment of the gate assembly. FIG. 6 is an elevational view and FIG. 7 is a plan view.

In FIG. 6 it is seen that there is a ground 118. There is positioned in the ground 118 the tubular support and guide 20. Also, there is positioned in a spaced apart relationship with the tubular support and guide 20 a latching post 120 comprising a tubular member 122. The tubular member 122 is also in the ground 118. There is positioned on the tubular member 122 a latch 124. The latch comprises a base 126. On the outer part of the base 126 there is an outwardly and upwardly directed flange 128. The flange 128 is spaced apart from the exterior of the tubular member 122. In FIG. 7 it seen there is a semi-circular strap 130 having threaded ends 132. In the base 126 there are two spaced apart holes or passageways. The ends of the threaded ends 132 project through these holes or passageways. Nuts 134 are screwed onto the threaded ends 132 to firmly and definitely position the latch 124 on the tubular member 122 of the latching post 120.

There is a gate 140 comprising two spaced upright stiles 141 and 142. There are a plurality of horizontal rails 144 connecting with the stiles 141 and 142.

On the stile 142 it is seen that there is a bar 146. The stile 142 and the bar 146 are connected by fasteners 148.

It is seen that there is positioned on the tubular support and guide 20 the outer rotatable follower 100. Also, it is seen that the stop 28 is at the ground level 150. A hinge 160 is positioned on the outer rotatable follower 100. The hinge 160 comprises a base 162. Fasteners 164 connect the base 162 and the upright stile 141. A strap 166 having threaded ends 168 wraps partially around the outer rotatable follower 100. In the base 162 there are two spaced apart holes or passageways, one in each side of the outer rotatable follower 100. Nuts 170 are screwed onto the threaded ends 168, outside of the base 162, to firmly attach the hinge 160 to the outer rotatable follower 100. In FIG. 6 it is seen that there is a lower hinge 160 and an upper hinge 160.

In FIG. 6 it is seen that in the upper part of the tubular support and guide 20 that there is the guide 30 or the guide slot 30. There is the lower part 32 of the guide 30 and the curved upper part 34 of the guide 30. In fact, in FIG. 6 it is seen that there are two guides 30 or two guide slots 32. Again, the pin assembly 80 is positioned so that parts of the pin assembly 80 are in the two guide slots 30.

The lower end of the tubular support and guide 20 can be positioned in concrete 176 for stability.

Further, in certain instances it may be desirable to have an integral gate assembly comprising the tubular support and guide 20, the inner moveable guide follower 50 and the outer rotatable follower 100 and the latching post 120. To achieve this it is possible to have a brace 180 connect with the lower end of the tubular support and guide 20 on the lower end of the tubular member 122. The result is an integral gate assembly. The gate assembly can be prepared, including the gate 140, at a factory. Then the gate assembly can be transported to the site of usage. Appropriate holes dug in the ground for the tubular support and guide 20, the tubular member 122, the brace 180 and the concrete 176. The gate assembly can be positioned in these appropriate holes and the concrete 176 poured.

In effect, FIG. 6 shows one form of a gate assembly comprising the tubular support and guide 20 with the inner moveable guide follower 50 and the outer rotatable follower 100 separated from the latching post 120. The other form is the tubular support and guide 20 with 50 and 100 positioned on 120 and connecting with latching post 120 by means of brace 180 to make an integral unit.

In FIG. 6 it is seen that the pin assembly 80 is so positioned that the rods 84 and 88 are in the lower part 32 of the guide slot 30. With the activation of the electric motor 58 the screw 70 rises. With the rising or elevation of the screw 70 the pin assembly rises in the lower part 32 of the guide 30. The rise is substantially vertical and therefore the bar 146 rises vertically and upwardly so as to be away from the flange 128 of latch 124. After the bar 146 is moved upwardly and away from the flange 128 the rods 84 and 88 enter the curved part 34 of the guide slot 30 and still move upwardly and also rotate through approximately 90° so that the gate 140 rotates through approximately 90°, see FIG. 7.

Conversely, to rotate the gate 140 and to lower the gate 140 and to have the bar 146 in the latch 124 the electric motor 58 can be activated. The screw 70 is retracted into the screw housing 68 and the rods 84 and 88 move downwardly in the curved upper part 34 of the guide 30. With the downward movement in the curved upper part 34 the gate 140 rotates through 90°. The bar 146 is adjacent to the tubular member 122. Then, with the rods 84 and 88 moving downwardly in the lower part 32 of the guide 30 the bar 146 will move downwardly so as to be between the tubular member 122 and the flange 128. In this manner the gate 140 is locked into position.

Figure 8:
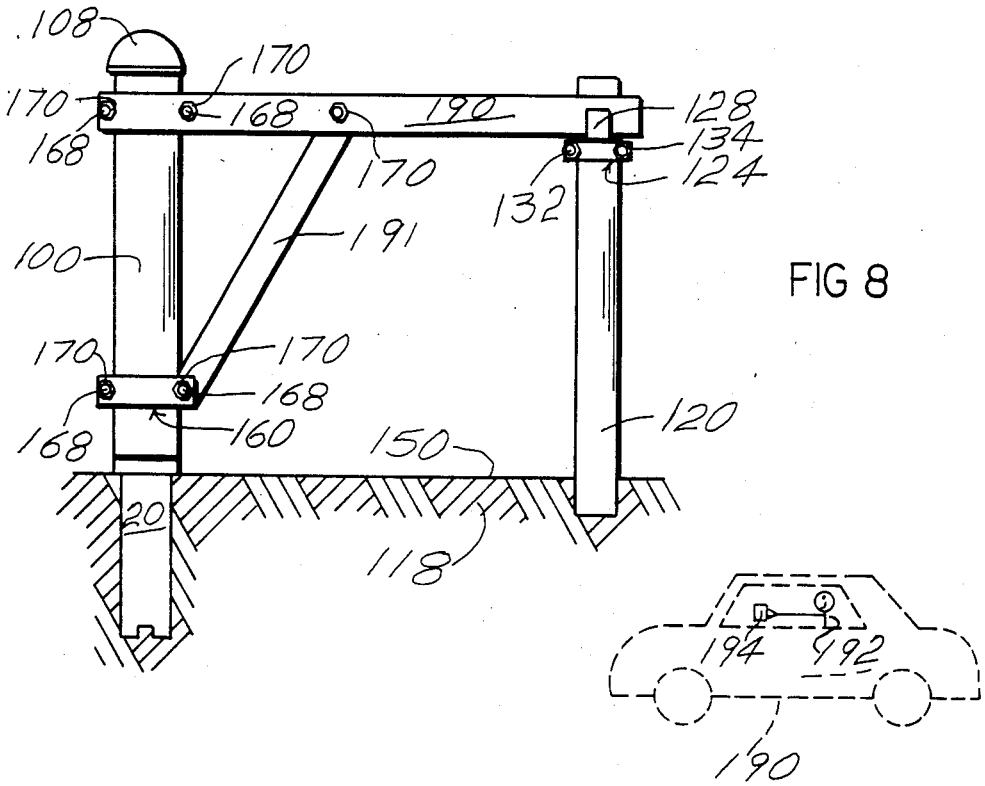
FIG. 8 is an elevational view of another species of the gate assembly and illustrates the tubular support and guide, the outer rotatable follower in a lowered position on the tubular support and guide, a bar attached to the outer rotatable follower and a latching post, and, FIG. 9 is a schematic illustration of the control unit, a battery, an antenna, a light, and the electric motor and gear box.

In FIG. 8 there is illustrated another gate assembly. Again, there is the tubular support and guide 20, the outer rotatable follower 100 and the inner moveable guide follower 50. There is the latching post 120. Instead of the gate 140 comprising stiles and rails there is a bar 190. There is a hinge 160 below the bar 190 and which hinge connects with the outer rotatable follower 100. There is a semi-circular strap 166 having threaded ends 168. The threaded ends 168 project through passageways in the hinge 160 and are attached by nuts 170 to the hinge 160. This definitely positions the hinge 160 on the outer rotatable follower 100. A diagonal brace 191 connects the hinge 160 with the bar 190. The bar connects with the outer rotatable follower 100 by means of a semi-circular strap 166 having threaded ends 168. The threaded ends 168 project through openings or holes in the bar 190. There are nuts 170 on the threaded ends 168. On the latching post 120 there is a latch 124. In FIG. 8 and with the elevation of the screw 70 the bar 190 is elevated and rotated away from the latching post 120 as described with respect to FIGS. 6 and 7.

Conversely, with the lowering of the screw 70 the bar 190 rotates downwardly so as to be between the latching post 120 and the flange 128. Then, the bar is lowered. The bar 190 is definitely positioned with respect to the latching post 120.

In FIGS. 7 and 8 there is illustrated an automobile 190 having an occupant 192. The occupant 192 is holding a transmitter 194 for opening and closing the gate 140 or the bar 190. In this manner the occupant does not have to get out of the automobile to open and close the gate.

Figure 9:
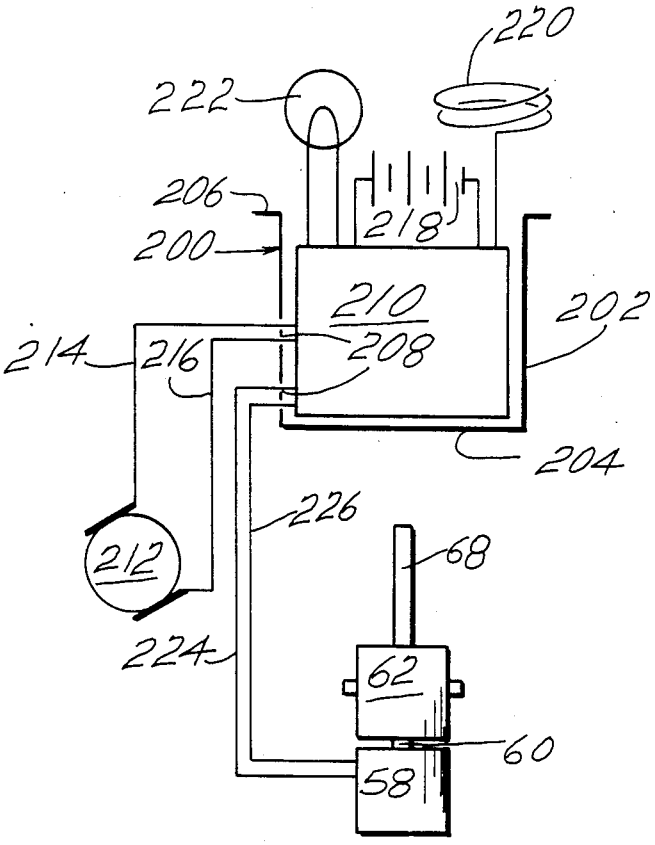

In FIG. 9 there is a schematic illustration of the control unit for operating the gate assembly. There is illustrated the direct current electric motor 58, output shaft 60, gear box 62 and screw housing 68.

There is a housing 200 having a circular wall 202 and a bottom wall 204. On the upper part of the circular wall 202 there is a circumscribing lip 206. In the circular wall 202 there are passageways or holes 208. In the housing 200 there is the control unit 210. The housing 200 is plastic and a dielectric.

There is a commerical generator 212 for supplying alternating current such as 110 volts AC, 220 AC or 440 volts AC. Electric lines 214 and 216 connect the commercial generator 212 and the control unit 210. The lines 214 and 216 are positioned in one of the passageways 208. With reference to FIG. 1 the lines 214 and 216 can extend through the nipple 42 and the lower part of the lower member 22.

There is a battery 218. The battery 218 can be 12 volts DC. The battery 218 connects with the control unit 210. There is an antenna 220 which connects with the control unit 210. The antenna 220 is positioned inside of the plastic cap 108. There is an electric light bulb 222 which connects with the control unit 210. The electric light bulb 222 is also positioned inside of the plastic cap 108. Electric lines 224 and 226 connect with the direct current electric motor 58 and also are in one of the passageways 208 and connect with the control unit 210.

The direct current electric motor 58 can be a 12 volt DC motor. The control unit 210 controls the activation of the electric motor 48 and thereby the gear box 62, the screw housing 68 and the screw 70 for elevating and for lowering the screw 70. As previously explained with the elevation and the lowering of the screw 70 the position of the outer rotatable follower 100 is changed to elevate and to lower the gate 140 or 190 and also to rotate the gate 140 or 190. The control unit 210 can adjust the voltage of the commercial generator 212 from say 120 or 240 volts AC to 12 volts DC. As a backup source of electrical energy, in case the commercial generator 212 is not available, the 12 volt direct current battery 218 can be used for activating the electric mctor 58. Further, the control unit 212 controls the electric light bulb 222. There is an antenna 220 which connects with the control unit 210. The accupant 192 of the automotive vehicle 190 by means of the transmitter 194 can send electromagnetic wave signals to the antenna 220 to control the electric motor 58. Further, the control unit 212 comprises a battery charger for maintaining the electric charge on the battery 218.

Generally, the primary source of electrical energy will be the commercial generator 212. If the commercial generator 212 fails or is not available then there is a backup source of electrical energy. The backup source of electrical energy is the battery 218.

If both the commercial generator 212 and the battery 218 are not available it will be necessary to move the gate 140 or the gate 190 by manual means. In order to do this the bolt 106 is screwed out of the tapped passageway 104 so that the outer rotatable follower 100 is no longer connecting with the inner rotatable guide follower 50. With the removal of the bolt 106 it is possible for a person to lift the gate 140 or to lift the gate 190 and to rotate the outer rotatable follower 100 and the associated gate. In this manner, even though there is a failure in the electrical power supply 212 and/or 218 the gate 140 or the gate 190 can be rotated so as to open the area for passage of an automobile vehicle or an individual or another object.

From the foregoing it is seen that some of the objects and advantages of this invention that it is possible to open and close a gate while remotely positioned from the gate such as being in an automotive vehicle; that less time is required with this invention to open the gate, drive the automotive vehicle through. the. open passageway, and then close the gate as compared with stopping the automotive vehicle, getting out and manually opening the gate, getting back into the automotive vehicle, driving the automotive vehicle through the open passageway, stopping the automotive vehicle and getting out of the automotive vehicle, closing the gate and then getting back into the automotive vehicle; and, that there is a safety factor involved with the remote opening of the gate while in the automotive vehicle as there is no chance of a person slipping and/or falling on snow and mud and also there is no chance of being mugged or attacked while out of the automotive vehicle.

From the foregoing description it is seen that I have provided a gate assembly comprising a tubular support and guide, hereinafter identified as a tubular guide, having a recess indentified as a first recess; an inner rotatable guide follower, hereinafter identified as an inner follower, having a recess identified as a second recess; an outer rotatable follower, hereinafter identified as an outer follower, having a recess identified as a third recess; said inner follower being in said first recess and having an exterior dimension smaller than the interior dimension of said first recess to allow said inner follower to move and to rotate in said first recess; part of said tubular guide being in said third recess; said third recess having an interior dimension larger than the exterior dimension of said tubular guide to allow said outer follower to move and to rotate with respect to said tubular guide; said tubular guide having a guide means for guiding said inner follower and said guide means having both a first direction and a second direction; said inner follower having a guide follower operatively connecting with said guide means for guiding the movement and the rotation of said inner follower in said first direction and in said second direction; said first direction and said second direction being substantially at a right angle to each other; a means identified as a first means connecting together said inner follower and said outer follower for said inner follower and said outer follower to move in unison; a means identified as a second means operatively connecting with said inner follower to move said inner follower; said guide means comprising a slot in said tubular guide; said slot comprising said first direction and said second direction wherein said first direction and said second direction are substantially at a right angle; said slot extending through a change in elevation and extending through a change in horizontal position; said guide follower in moving in said slot and therefore said inner follower move both vertically and horizontally; said second means comprising a secrew; said screw operatively connecting with said inner follower; a means to rotate said screw to vary the elevation of said screw and thereby to vary the position of said inner follower and of said outer follower; a control for controlling said second means; said control comprising a receiver for electromagnetic waves for remote control of said gate assembly; a gate; an adapter; and, said adapter operatively connecting together said gate and said outer follower.

With the foregoing presentation of my invention what I claim is:

1. A gate assembly comprising:

a. a tubular support and guide, hereinafter identified as a tubular guide, having a recess identified as a first recess;

b. an inner rotatable guide follower, hereinafter identified as an inner follower, having a recess identified as a second recess;

c. an outer rotatable follower, hereinafter identified as an outer follower, having a recess identified as a third recess;

d. said inner follower being in said first recess and having an exterior dimension smaller than the interior dimension of said first recess to allow said inner follower to move and to rotate in said first recess;

e. part of said tubular guide being in said third recess;

f. said third recess having an interior dimension larger than the exterior dimension of said tubular guide to allow said outer follower to move and to rotate with respect to said tubular guide;

g. said tubular guide having a guide means for guiding said inner follower and said guide means having both a first direction and a second direction;

h. said inner follower having a guide follower operatively connecting with said guide means for guiding the movement and the rotation of said inner follower in said first direction and in said second direction;

i. said first direction and said second direction being substantially at a right angle to each other;

j. a means identified as a first means connecting together said inner follower and said outer follower for said inner follower and said outer follower to move in unison; and, k. a means identified as a second means operatively connecting with said inner follower to move said inner follower.

2. A gate assembly according to claim 1 and comprising:

a. said guide means comprising a slot in said tubular guide;

b. said slot comprising said first direction and said second direction wherein said first direction and said second direction are substantially at a right angle;

c. said slot extending through a change in elevation and extending through a change in horizontal position; and, d. said guide follower being in said slot.

3. A gate assembly according to claim 1 and comprising:

a. said second means comprising a screw;

b. said screw operatively connecting with said inner follower; and, c. a means to rotate said screw to vary the elevation of said screw and thereby to vary the position of said inner follower and of said outer follower.

4. A gate assembly according to claim 1 and comprising:

a. said second means comprising a screw assembly;

b. said screw assembly comprising an electric motor, a gear box and a screw housing, a screw and a connecting means;

c. said screw and connecting means operativley connecting with said inner follower; and, d. said electric motor and said gear box and said screw housing cooperate to rotate said screw to vary the position of said screw and thereby to vary the position of said inner follower.

5. A gate assembly according to claim 1 and comprising:

a. a control for controlling said second means; and, b. said control comprising a receiver for electromagnetic waves for remote control of said gate assmembly.

6. A gate assembly according to claim 1 and comprising:

a. a control for controlling said second means;

b. said control comprising a receiver for electromagnetic waves for remote control of said gate assembly;

c. said control having means for regulating the flow of electricity in said gate assembly;

d. a battery operatively connecting with said control; and, e. said control having means for adjusting the charge of said battery.

7. A gate assembly according to claim 1 and comprising:

a. said guide means comprising a slot in said tubular guide;

b. said slot comprising said first direction and said second direction wherein said first direction and said second direction are substantially at a right angle;

c. said slot extending through a change in elevation and extending through a change in horizontal position;

d. said guide follower in moving in said slot and therefore said inner follower move both vertically and horizontally;

e. said second means comprising a screw;

f. said screw operatively connecting with said inner follower;

8. A gate assembly according to claim 1 and comprising:

a. a gate;

b. an adapter; and, c. said adapter operatively connecting together said gate and said outer follower.

9. A gate assembly according to claim 8 and comprising:

a. a latching post;

b. said latching post and said tubular guide being spaced apart; and, c. said gate upon moving being capable of assuming a position juxtapositioned to said latching post.

10. A gate assembly according to claim 9 and comprising:

a. a brace operatively connecting with the lower part of said tubular guide and with the lower part of said latching post to make an integral gate assembly comprising said tubular guide, said inner follower, said outer follower, said latching post and said brace.

11. A gate assembly according to claim 9 and comprising:

a. said gate comprising stiles and rails.

12. A gate assembly according to claim 9 and comprising:

a. said gate comprising a bar.

13. A gate assembly according to claim 1 and comprising:

a. said guide means comprising a slot in said tubular guide;

b. said slot being continuous and having a lower part which runs upwardly and downwardly and an upper part which curves so as to run as a combination of upwardly and downwardly and horizontally; and, c. said guide follower being in said slot.

14. A gate assembly according to claim 13 and comprising:

a. said second means comprising a screw;

b. said screw operatively connecting with said inner follower;

c. a means to rotate said screw to vary the elevation of said screw and thereby to vary the position of said inner follower and of said outer follower;

d. a control for controlling said second means; and, e. said control comprising a receiver for electromagnetic waves for remote control of said gate assembly.

15. A gate assembly according to claim 14 and comprising:

a. a gate;

b. an adapter;

c. said adapter operatively connecting together said gate and said outer follower;

d. a latching post;

e. said latching post and said tubular guide being spaced apart; and, f. said gate upon moving being capable of assuming a position juxtapositioned to said latching post.

16. A gate assembly according to claim 15 and comprising:

a. a brace operatively connecting with the lower part of said tubular guide and with the lower part of said latching post to make an integral gate assembly comprising said tubular guide, said inner follower, said outer follower, said latching post and said brace.

17. A gate assembly according to claim 13 and comprising:

a. said guide follower comprising a sleeve, a first rod, a second rod, a first bearing and a second bearing;

b. said sleeve having a passageway identified as a first passageway;

c. part of said first rod being in said first passageway;

d. said first bearing being on said first rod and adjacent to said sleeve;

e. part of said second rod being in said first passageway;

f. said second bearing being on said second rod and adjacent to said sleeve;

g. said guide means comprising a first slot and a second slot in said tubular guide;

h. each of said slots being continuous and having a lower part which runs upwardly and downwardly and an upper which curves so as to run as a combination of upwardly and downardly and horizontally;

i. part of said first rod being in said first slot; and, j. part of said second rod being in said second slot.

18. A gate assembly according to claim 17 and comprising:

a. said second means comprising a screw assembly;

b. said screw assembly comprising an electric motor, c. said screw and connecting means operatively connecting with said inner follower;

d. said electric motor and said gear box and said screw housing cooperate to rotate said screw to vary the position of said screw and thereby to vary the position of said inner follower;

e. a control for controlling said second means;

f. said control comprising a receiver for electromagnetic waves for remote control of said gate assembly;

g. said control having means for regulating the flow of electricity in said gate assembly;

h. a battery operatively connecting with said control; and, i. said control having means for adjusting the charge of said battery.

19. A gate assembly according to claim 18 and comprising:

a. a gate;

b. an adapter;

c. said adapter operatively connecting together said gate and said outer follower;

d. a latching post;

e. said latching post and said tubular guide being spaced apart; and, f. said gate upon moving being capable of assuming a position justapositioned to said latching post.

20. A gate assembly according to claim 19 and comprising:

a. a brace operatively connecting with the lower part of said tubular guide and with the lower part of said latching post to make an integral gate assembly comprising said tubular guide, said inner follower, said outer follower, said latching post and said brace.

* * * * *